US005127803A

United States Patent [19]

Walter

[11] Patent Number: 5,127,803

[45] Date of Patent: Jul. 7, 1992

[54] PUMP TOOL

[76] Inventor: James C. Walter, 5201 Locust Grove, Apt. 240, Garland, Tex. 75043

[21] Appl. No.: 480,952

[22] Filed: Feb. 16, 1990

[51] Int. Cl.[5] ..... F02B 47/12

[52] U.S. Cl. ..... 417/57; 417/56; 417/60

[58] Field of Search ..... 417/56, 57, 58, 59, 417/60, DIG. 1; 92/85 R

[56] References Cited

U.S. PATENT DOCUMENTS 4,070,134 1/1978 Grambling ..... 417/56
4,259,858 4/1981 Freeman et al. ..... 92/85 R
4,880,366 11/1989 Stinson ..... 417/555.1
4,889,473 12/1989 Krueger ..... 417/56

*Primary Examiner*—Richard A. Bertsch
*Assistant Examiner*—Charles G. Freay
*Attorney, Agent, or Firm*—Richards, Medlock & Andrews

[57] ABSTRACT

An improved pump tool (10, 110, 200) is provided for lifting oil from within a casing 18 of a well. The gas in the well provides the lifting action. The pump tool includes a body (22) which is preferably formed of ABS plastic. The body defines an upper chamber (24) and a lower chamber (26) which is connected through a hydrostatically operated valve (44). The plastic body weighs less, is chemically resistant and reduces the risk of spark and explosion.

6 Claims, 10 Drawing Sheets

PUMP TOOL

TECHNICAL FIELD

This invention relates to oil production, and in particular to a plunger pump utilizing well gas pressure to lift oil.

BACKGROUND OF THE INVENTION

The use of plunger pumps to produce oil from a well having usable gas pressure is well known. In basic principle, a plunger pump is dropped from the surface through the well casing or tubing and into the oil/gas mixture downhole. A mechanism, typically one operated by hydrostatic pressure, closes a passage in the plunger pump to allow gas pressure to build up beneath the pump. The gas pressure builds to a point where it lifts the pump, and a quantity of oil above the pump, to the surface where the oil is recovered. The gas pressure beneath the pump is relieved to allow the pump to fall downhole again to re-initiate the sequence.

One example of a plunger pump is disclosed in U.S. Pat. No. 4,070,134, issued Jan. 24, 1978 to Gramling. However, this device has not proven reliable in actual use, and a need exists for an improved plunger pump which provides for efficient production of oil, condensate, and de-watering of gas wells, either through casing or tubing. For simplicity, the following discussion will be limited to the plunger pump application in casing, with the understanding that the same principles of operation can be applied to its use in tubing.

SUMMARY OF THE INVENTION

In accordance with one aspect of the present invention, a tool is provided for pumping oil from a gaseous well through a casing of predetermined internal diameter extending from the surface to below the oil level. The tool includes a body formed of plastic, with the body defining an upper chamber and a lower chamber therein. At least one seal is employed to seal between the exterior of the body at a first position along the body and the inner surface of the casing to prevent oil or gas flow past the exterior of the body. In the preferred embodiment, two seals are utilized. The body has an upper vent to vent the upper chamber to the exterior of the body above the seals. The body also has a lower vent to vent the lower chamber to the exterior of the body below the seals. A separator is provided for separating oil from a gaseous oil mixture and permitting the separated oil to flow into the upper chamber. Structure is provided for stopping the flow of the separated oil into the upper chamber, permitting the gas pressure to build up in the casing below the tool and lift the tool, and the oil in the upper chamber and casing above the seal to the surface for recovery.

In accordance with another aspect of the present invention, the plastic is ABS plastic. Further, structure can be provided for free communication between the upper and lower chambers prior to the tool being submerged below the oil level to provide for rapid movement of the tool from the surface to the oil level. Further, structure can be provided to control the fall of the tool from the surface to the oil level.

BRIEF DESCRIPTION OF THE DRAWINGS

With reference now to the following Detailed Description taken in conjunction with the accompanying drawings, wherein.

DETAILED DESCRIPTION

Figure 1:
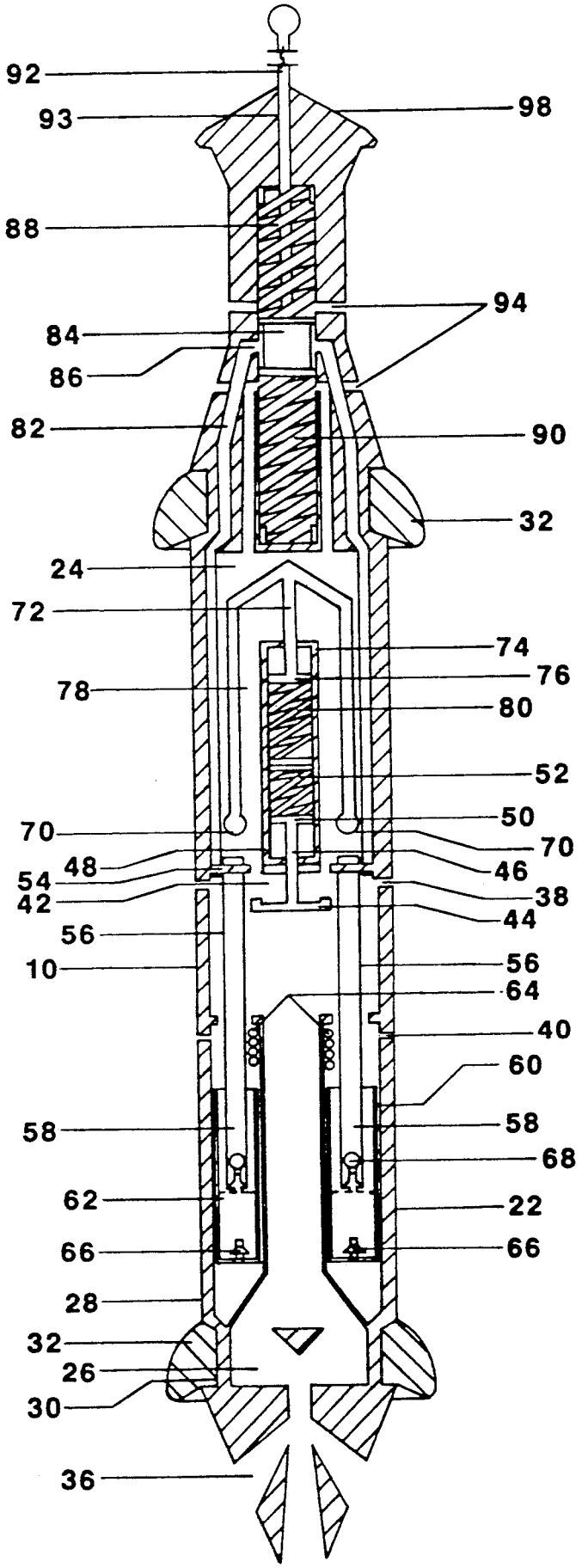
FIG. 1 is a vertical cross sectional view of a pump tool forming a first embodiment of the present invention.
Figure 1A:
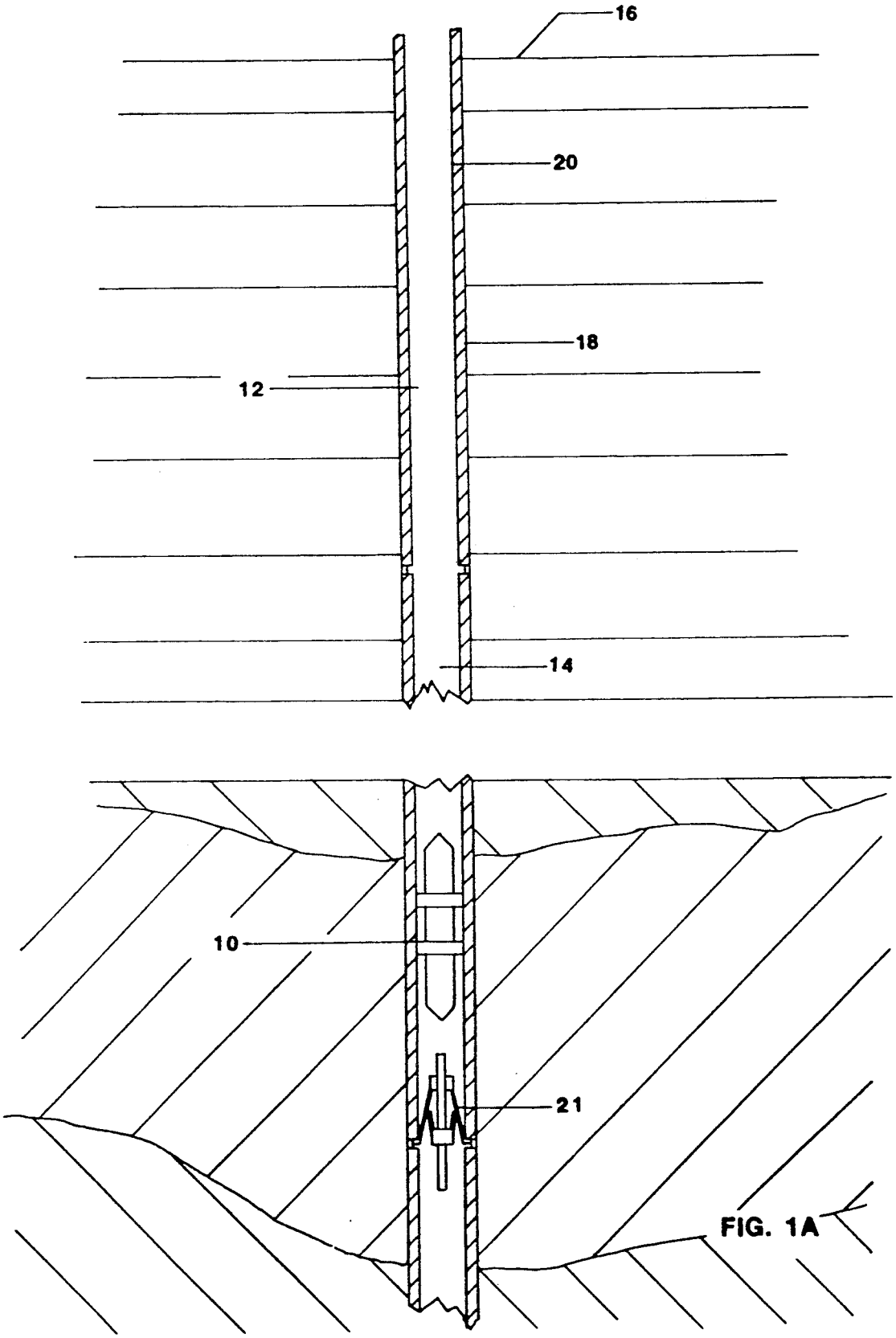
FIG. 1A is an illustrative view of a well in which the pump tool can be used.

With reference now to the drawings, wherein like reference numerals designate like or corresponding parts throughout the several views, and in particular to FIGS. 1 and 1A, a pump tool 10 is illustrated which forms a first embodiment of the present invention.

The pump tool 10 is employed within a well 12 having a significant gas pressure to pump oil from its natural level 14 to the surface 16 by the use of the gas pressure within the well alone. The pump tool 10 operates within a casing 18 of relatively uniform interior diameter 20 which extends from the surface to well below the oil level 14. A stand 21 is secured in the casing 18 above the perforations into the producing formation.

The pump tool 10 includes a body 22 which is preferably formed of ABS plastic. The body 22 has a hollow interior which is broadly separated into an upper chamber 24 and a lower chamber 26.

At one position along the length of the exterior 28 of the body is formed an annular seat 30 for a cup seal 32. The cup seal 32 seals between the exterior of the pump tool and the inner wall of the casing 18 to prevent oil or gas from flowing around the exterior of the pump tool past the seal. Thus, the only path for gas and oil flow in the casing between the section above the seal and the section below the seal is through the interior of the tool 10 itself.

A labyrinth passage 36 in the body connects the bottom of the lower chamber 26 with the interior of the casing below the seal. The purpose of the labyrinth passage 36, as will be described in greater detail hereinafter, is to provide sufficient aerodynamic resistance to the tool as it drops freely from the surface to the oil level 14 to prevent the tool from exceeding a velocity that would be likely to cause excessive wear to the seal 32 or damage to the tool as it drops into the oil downhole. A series of gas vents 38 and 40 are formed through the body near the top of the lower chamber 26 at two positions along the length of the tool.

The body 22 provides an annular opening 42 which connects the upper and lower chambers. However, a valve 44 is operable to seal against the body to close off the opening 42 and isolate the upper and lower chambers. The valve 44 is connected to a stem 46 extending into a sealed cylinder 48 formed in the body. The end of stem 46 is attached to a piston 50 which moves in sealed sliding contact with the interior surface of the sealed cylinder 48. A spring 52 acts between the interior end of the cylinder 48 and the upper surface of piston 50 to urge the piston 50 to the open position, allowing free flow between the upper and lower chambers. A gas is sealed within the cylinder in the chamber defined by the upper surface of the piston and the enclosing interior walls of the cylinder. The force of the spring 52 and the gas are sufficient to hold the valve open as the tool is dropped from the surface into the oil to facilitate rapid movement of the tool. However, once the tool drops below the oil level, the hydrostatic pressure of the oil will act on the lower face of the valve 44, causing the valve 44 to close and isolate the upper and lower chambers.

Forming the outer perimeter of the annular opening 42 is an annular plate 54. A pair of tubes 56 extend from the plate 54 downward into the lower chamber 26. The tubes have a passage 58 therethrough which provide for communication between the upper chamber and lower chamber Guided on tubes 56 is an annular float 60. The float defines an annular chamber 62 which communicates with the lower chamber through ports 64 near the upper end of the chamber 62. The lower ends of tubes 56 extend through the float and into the chamber 62 as illustrated. A tube seal 66 is mounted at the bottom of chamber 62 beneath each of the tubes 56 to seal the passages 58 from the chamber 62 if the chamber 62 floats upward to the position denoted in the dotted line in FIG. 1. Within each tube 56 is also provided a fall valve 68 which permits only one-way flow from the chamber 62 into the passages.

The tubes 56, float 60 and seal ball 68 combine to form an oil separator for separating oil from a oil gas mixture in the lower chamber. The fundamental principles of the separator are disclosed in U.S. Pat. No. 3,410,217, issued Nov. 12, 1968 to Kelly, et al, which patent is hereby incorporated by reference in its entirety.

In operation, the float will move upward into the dotted line position, isolating the chamber 62 from passages 58, when there is an oil/gas mixture in the chamber 62. However, as oil rises in the casing to the level of the ports 64, the oil will fill the chamber 62, making the float heavier relative to the oil and gas mixture in the lower chamber and permitting the float to descend within the chamber to the position shown in FIG. 1. This opens the float connection between chamber 62 and the passages 58 to allow the pump tool 10 to descend further into the casing with the oil in chamber 62 moving through the passages into the upper chamber to fill the upper chamber, and out ports 34 to the interior of the casing above the cup seal 32.

The pump tool 10 continues to drop within the casing, with a hydrostatic head of oil above the tool until valves 70 move downward in the tool in response to the increased hydrostatic head to seal off the tubes 56 from the upper chamber 24. The valves 70 are mounted on a rod 72 which extends into a second sealed cylinder 74. The end of rod 72 extending into the cylinder is connected to a piston 76 which moves in slidable sealed motion with the interior surface of the cylinder 74. The chamber 78 formed below the lower surface of piston 76 and the interior of the cylinder contains a gas at predetermined pressure and a spring 80 which both act to elevate the seals above the tubes to connect the upper chamber and passages 58. However, as the hydrostatic head of the oil above the tool increases, the seals and rod 72 are moved downward relative to the seal chamber against the force of the gas in chamber 78 and spring 80 until the seals seal against the upper ends of the tubes to isolate the passages from the upper chamber. When this happens, gas pressure begins to build up in the lower chamber and in the casing below the cup seal 32. The pressure build-up will eventually be sufficient to lift the tool 10, and the oil above it, to the surface where the oil can be recovered. Once the tool has reached the surface, and the oil has been recovered, a mechanism must be provided to release the gas pressure beneath the tool to allow the tool to fall again down the casing to begin the lifting cycle anew.

Figure 2:
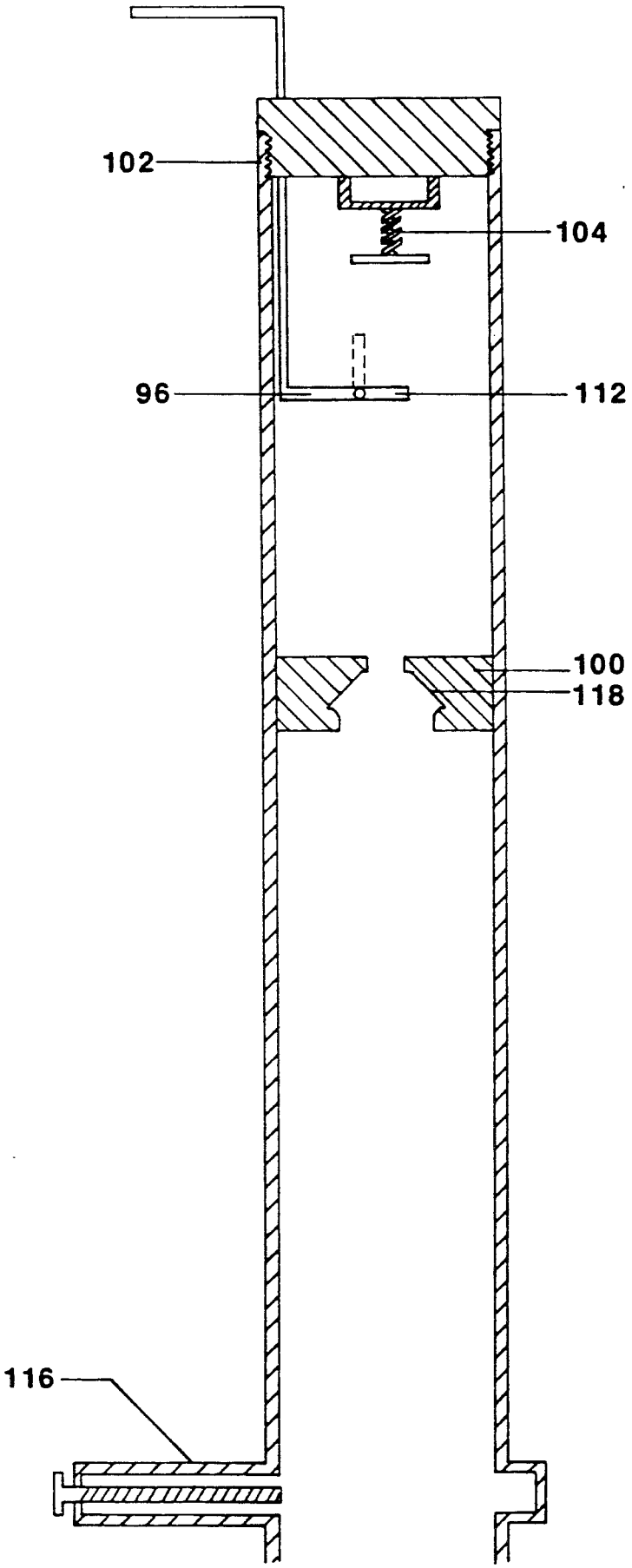
FIG. 2 is a vertical cross sectional view of a latch mechanism for the tool.

With reference to both FIGS. 1 and 2 the body 10 can be seen to define a passage 82 which receives a release piston 84. In the absence of external forces, the piston 84 is centered over ports 86 which connect the lower chamber with the upper chamber by springs 88 and 90. A rod 92 is connected to the piston and extends upwardly through a hole 93 in the body and for a predetermined distance above the tool. Ports 94 are formed through the body and open into the portion of the passage containing springs 88 and 90 to equalize the pressure on either side of the release piston 84.

The release piston 84, which acts as a pressure differential release system, is very important to allow release of a stuck tool. An important aspect of this system is that the pressure can be released by pulling up on the tool, as opposed to the conventional manner of striking a valve with a suspended weight. For example, in Gramblings' tool disclosed in U.S. Pat. No. 4,070,134, at least a 100 lb weight is required to strike the release valve. In the present invention, a conventional wire line fishing tool can easily release the back pressure and retrieve the tool all in one trip down the hole, without the problem of launching the tool when it becomes unstuck with a high pressure beneath it so that it becomes a projectile launched from the casing.

As seen in FIG. 2, the upper portion of the casing is provided with a release piston activator 104 which is positioned in the path of the rod as the tool nears the surface to release the gas pressure and permit the tool to fall again into the casing.

Figure 3:
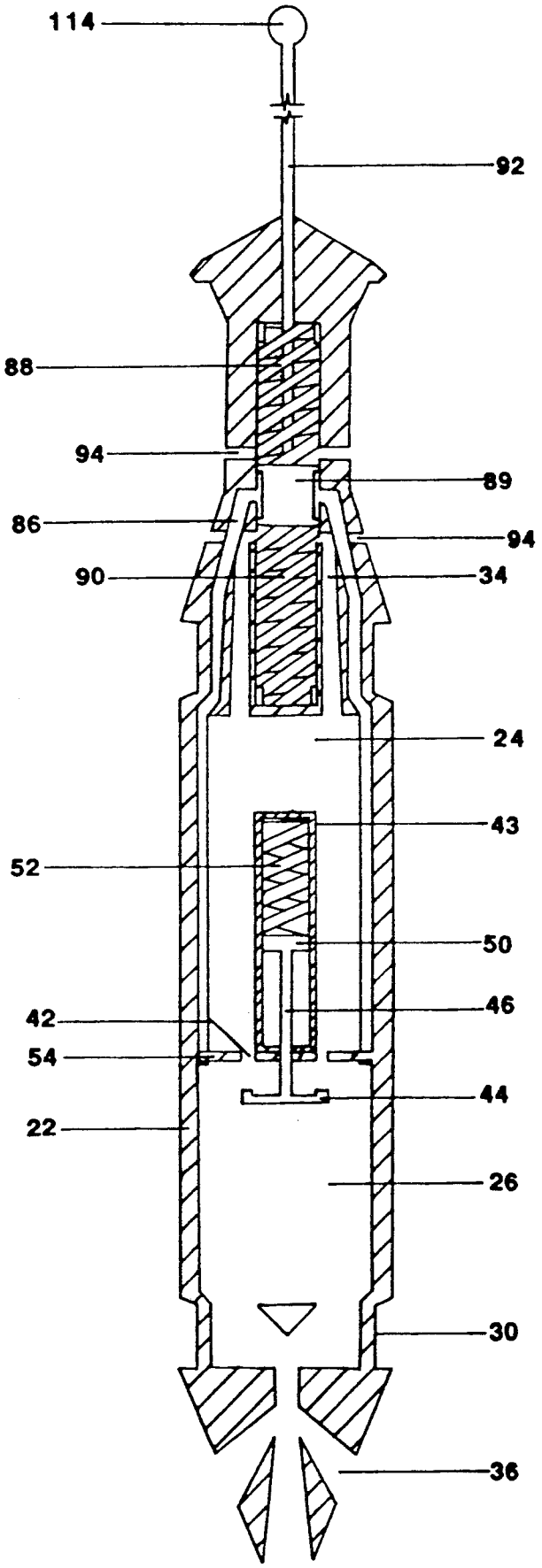
FIG. 3 is a vertical cross sectional view of a modification of the pump tool.

With reference to FIG. 3, a pump tool 110 forming a first modification of tool 10 is illustrated. The tool 110 is identical in many aspects with tool 10, and those elements of tool 110 identical to elements in tool 10 are identified with the same reference numerals. However, as will be observed, the tool 110 is a simpler design which does not incorporate an oil separator as provided in pump tool 10.

Figure 4:
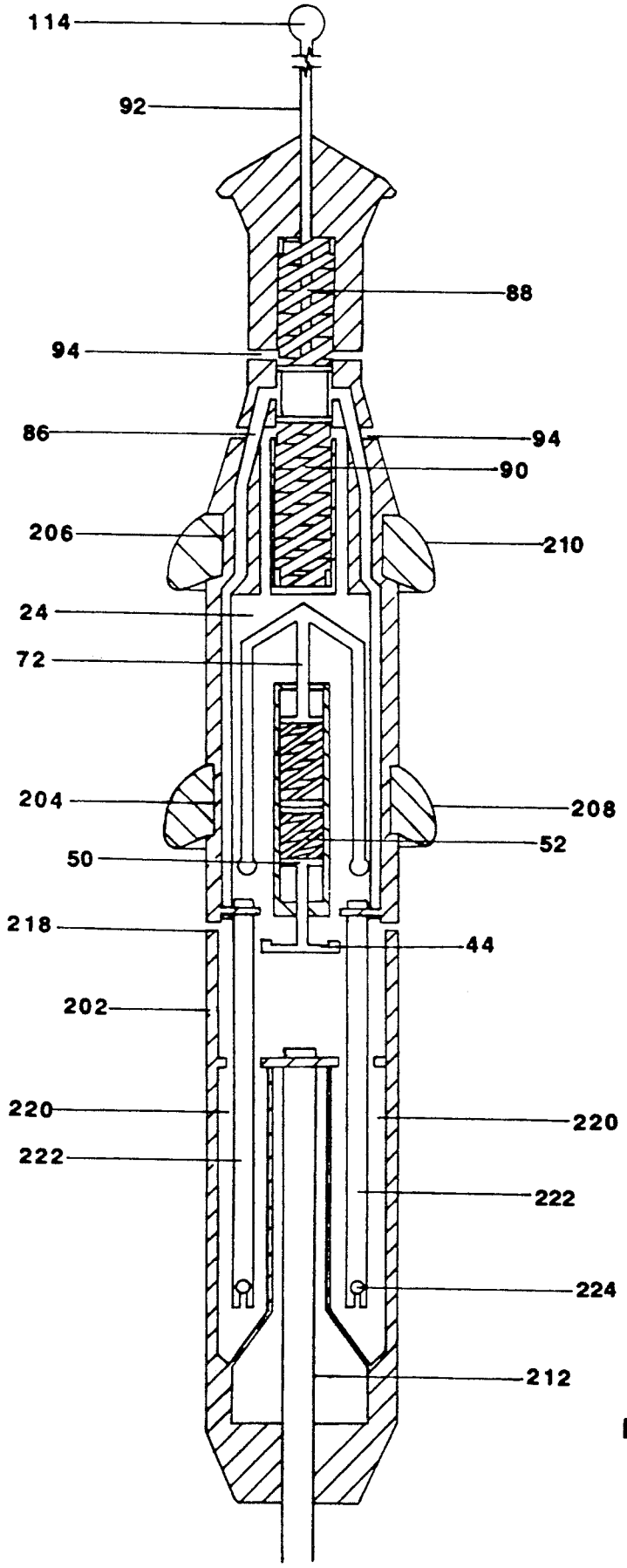
FIG. 4 is a vertical cross sectional view of a pump tool forming a second embodiment of the present invention.
Figure 5:
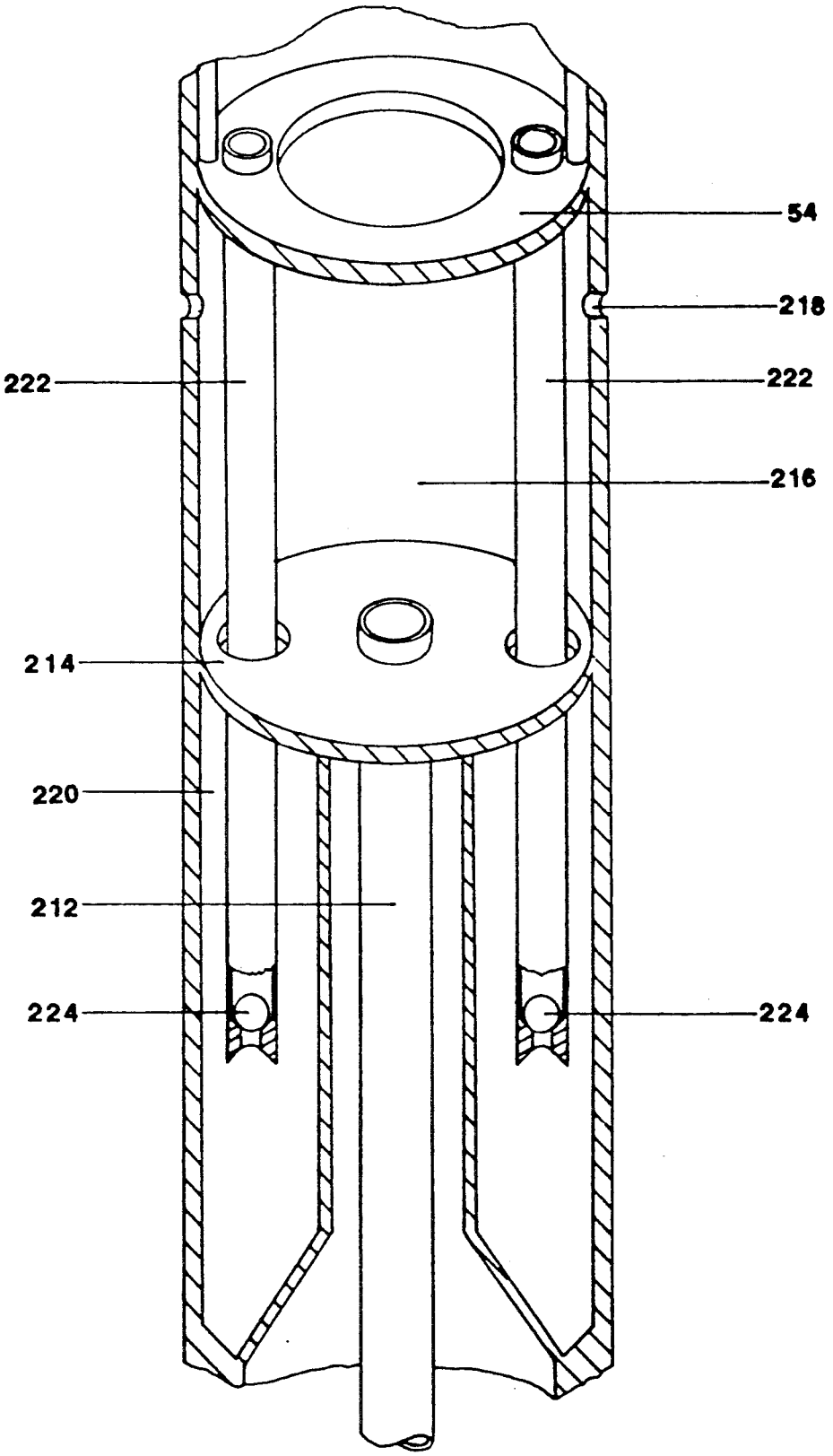
FIG. 5 is a detail view of a portion of the pump tool of FIG. 4.

With reference now to FIGS. 4 and 5, a second modification of the present invention is illustrated as pump tool 200. Many elements of pump tool 200 are identical in design and function to those in pump tool 10 and pump tool 110, and are therefore identified by the same reference numerals.

However, the body 202 of pump tool 200 can be seen to provide two annular seats 204 and 206 to receive cup seals 208 and 210 to seal between the body and the interior surface of casing 18. Body 202 also mounts an oil intake tube or tail 212 which extends downwardly into the oil within the casing. The tail 212 consists of a flexible tube, preferably assembled of 10 foot long sections which are attachable in series to any total tail length desired. Each section or length is weighted to keep the tail vertical and to allow it to sink into the oil.

In operation, the pump tool will cause gas to stay below the tool body 202, in effect causing a gas bubble to grow in the casing as more oil is processed. As compared to pump tool 10 and 110, the gas bubble generated cannot shut down the separator when the bubble grows down past the oil intake for the separator, thereby depriving the unit of the oil supply. The tail 212 allows the separator to continue functioning since it will ensure an oil supply to the separator at all times. Oil will be forced up the interior passage through the tail by the pressure differential between the area above the tool 200 and the sealed off area below the tool. A tail length of 40' to 60' could be used, for example, to ensure adequate separation.

As seen in FIG. 5, the upper end of the tail 212 opens into the separator 214 which includes a cavity 216 which is vented at its upper portion to the casing through gas venting ports 218. The oil can flow into annular cavities 220 to the bottom of the cavities and then up the interior of tubes 222. The lower end of each tube 222 mounts a one-way ball valve 224, while the upper end of each tube opens through the annular plate 54.

Referring again to FIG. 2, a movable arm 96 is provided at the surface which can be used to catch the tool 10, 110 or 200 for servicing. The arm can be moved from a stored position against the wall of the casing 18 to a central position, as seen in FIG. 2. The tool is then caught on its next upward trip by the arm. A spring loaded horseshoe 112 is mounted on the end of the movable arm which will lay horizontally, as seen in FIG. 2, until the head of the pump tool pushes it vertically as it passes by. When the head clears the horseshoe 112, spring loading will snap the horseshoe 112 back to a horizontal position, in which it will be surrounding the long neck portion of head 114 of the tool 10, 110 or 200. When the tool completes its upward trip, and starts to fall back down, the portion 114 will become wedged into the horseshoe, thereby leaving the tool hanging. The master valve 116 can then be closed and the tool safely removed for servicing.

The rubber bumper 100 acts as a safety device designed to catch the tool if it comes up the casing too fast. Under normal operating conditions, the body will not even touch the bumper, since the springs in the top of the tool should adequately cushion a normal trip termination. However, should the tool come up too hard, the springs in the body would not be sufficient to prevent damage. The rubber bumper 100 is put in such a position as to catch the head of the tool before damage can occur to the tool. The concave area 118 of the bumper is cut to fit the head of the tool. If the tool hits it very hard, it will become wedged in and thus suspended in the bumper 100. The master valve 116 can then be closed and the tool removed for servicing.

The use of a master valve 116 allows the well to be closed off before removing the tool, eliminating the risk of a blowout A one-way pressure valve on top of the unit will allow for safe operation of a wire-line unit used for cleaning casings as well as placing the stand, or fishing for a stuck pump tool. Older systems required these operations to be done with the well open to the atmosphere, and blowouts and fire hazards were a very dangerous by-product due to methane escaping from he open well.

The use of plastic in the tool has significant advantages. Plastic saves weight, which translates into more oil production per trip. Blowouts caused by sparks are a major danger for prior metal based tools. The use of plastic eliminates the risk of such sparks in removing or inserting the tool. Plastic can also function in salt water and hydrogen sulfide ($H_2S$) which corrode normal metal tools. Salt water is extremely common in wells, while hydrogen sulfide is less common, but does occur.

The springs used in the tool will be of spring metal, but will be coated in a synthetic covering to prevent corrosion. The head 114 and plunger rod 92 will be formed of brass or bronze, both of which are resistant to salt water and hydrogen sulfide corrosion. Further, neither brass nor bronze will spark against other metals, again lessening the chance of a fire. The stand 21 will utilize a mixture of plastic and coated metals, all of which will be corrosion resistant.

Figure 6:
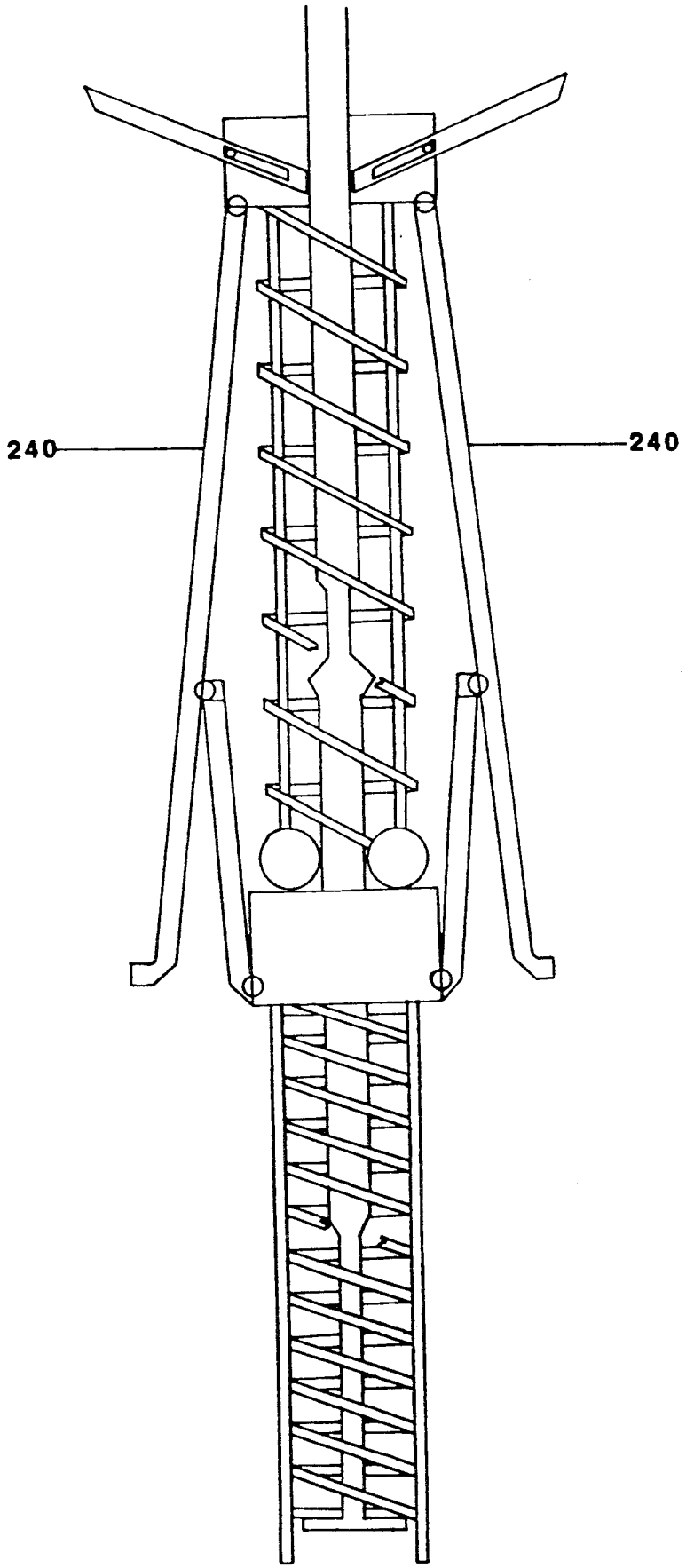
FIG. 6 is a side view of a stand utilized with the pump tool.

The stand 21 is used to prevent the tool from falling all of the way to the bottom of the well should a valve malfunction. The stand 21 should be set at the nearest casing joint above the perforations into the producing formation. As best seen in FIG. 6, the stand 21 can be seen to have spring loaded arms 240 which engage the sides of casing 18, preferably at a casing joint to provide a stable attachment of the stand to the casing. The manufacture of the body 22 in either pump tool 10 or pump tool 110 provides a significant advantage. For example, the overall weight of the tool can be reduced to a weight between about 10 and 20 lbs. as opposed to a weight of about 80 lbs. for casing pumps having bodies of metal. The weight saving translates directly to increased production of oil.

Figure 7:
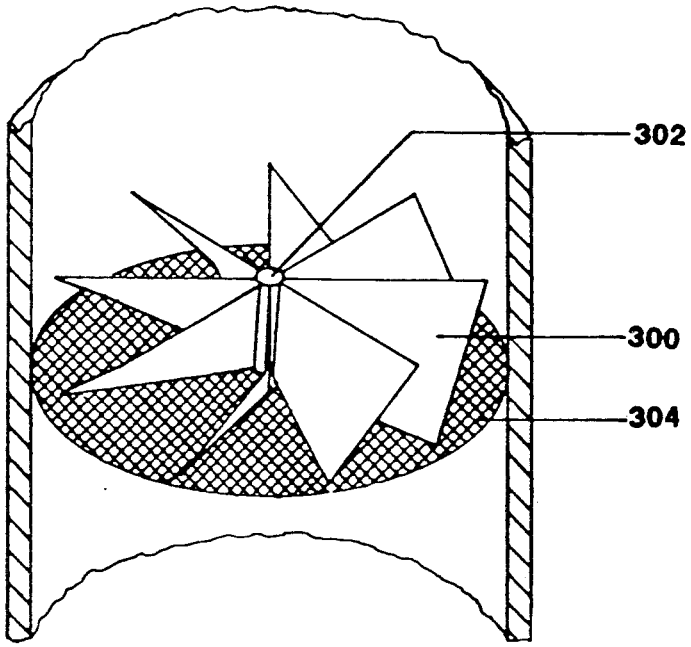
FIG. 7 is a perspective view of a horizontal wind turbine which can be used on the pump tools to slow descent.

With reference now to FIG. 7, a horizontal wind turbine 300 can be seen which is mounted for rotation on a shaft 302. Shaft 302, in turn, is secured to pump tool 10, 110 or 200 so that the wind turbine is placed in the air flow through the tools as the tools descend within the casing. An air inlet screen 304 can be used to prevent debris from injuring the blades of the turbine 300. The turbine has blades which are set to spin as the air flows past the blades as the tools descend in the casing. This provides resistance to the downward motion of the pump tool to slow the descent speed of the tools. In addition, the turbine can be mounted on the shaft so that the shaft rotates as well, which gives rise to the possibility of powering an electrical device on the tool by connecting the shaft to a generator.

Figure 8:
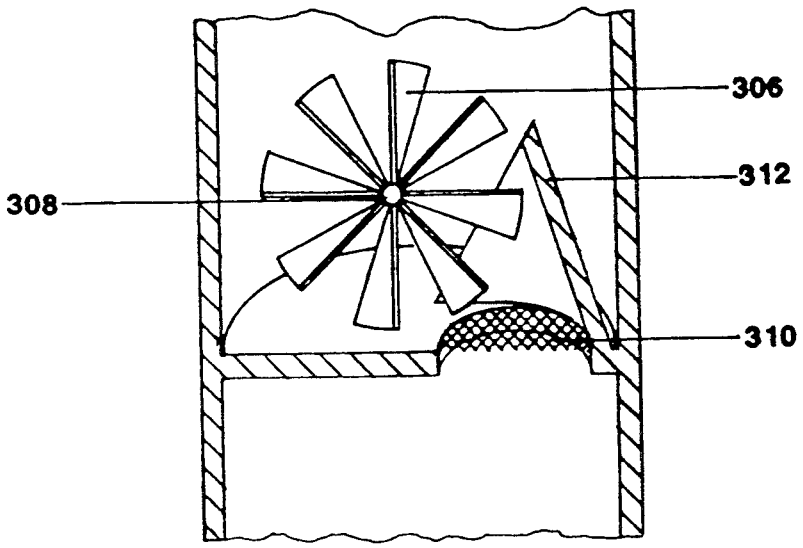
FIG. 8 is a perspective view of a vertical wind turbine which can be used to slow descent.

FIG. 8 shows a modification of the wind turbine concept with a vertically mounted wind turbine 306. The turbine would be mounted on a horizontally extending shaft 308. An air inlet screen 310 and an air guide 312 can be used to direct the air flow directly to the blades of the vertical wind turbine as illustrated.

Figure 9:
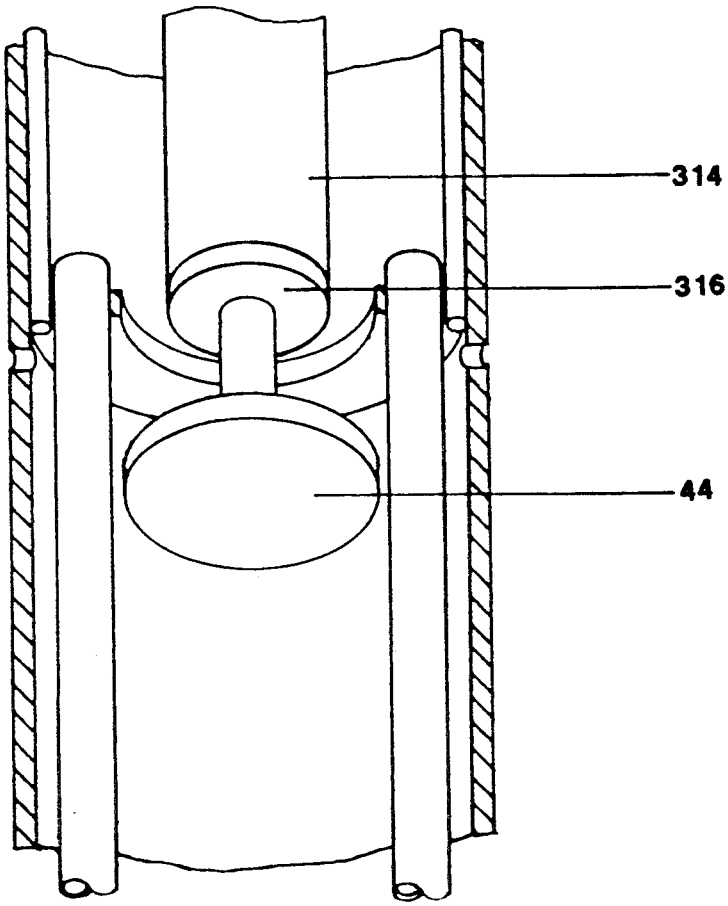
FIG. 9 is a magnetic valve seating apparatus which can be used on the tools.

FIG. 9 illustrates a magnetic valve seating apparatus 314 which can be used on pump tools 10, 110 and 200. The apparatus 314 includes an annular magnet 316 mounted on the tools as shown so that as valve 44 nears the closed position, the pressure that builds up around the valve face that could prevent full closure of the valve and a resulting stagnation of the rabbitt, is overcome by the magnetic attraction of the valve 44 to the magnet 316 to assure complete closure.

While only one embodiment of the present invention has been described in detail herein and shown in the accompanying drawings, it will be evidence that further modifications, or substitutions of parts and elements are possible without departing from the scope and spirit of the invention.

I claim:

1. A pump tool for pumping oil from a gaseous well having a casing of predetermined internal diameter extending from the surface to below the oil level, comprising:

a body formed of plastic and defining an upper chamber and a lower chamber therein, portions of the body coming into contact with the casing being formed of plastic top to prevent metal to metal contact that can create a spark;

means for forming a seal between the exterior of the body at a first position along the body and the adjacent inner surface of the casing to prevent oil or gas flow past the exterior of the body;

the body having an upper vent to vent the upper chamber to the exterior of the body above the seal means;

the body having a lower vent to vent the lower chamber to the exterior of the body below the seal means;

means for preventing flow from the lower chamber to the upper chamber when the tool has dropped below the oil level until a predetermined hydrostatic head of oil is provided above the pump tool to allow gas pressure to build up beneath the tool and lift the tool, and oil there above tot he surface; and the pump tool having a weight less than about twenty pounds as compared to equivalent metal pump tools of similar capacity having a weight of about eighty pounds to increase the production of oil.

2. The pump tool of claim 1 including means for controlling the fall rate of the pump tool within the casing.

3. The pump tool of claim 1 wherein the body is formed of ABS plastic.

4. The pump tool of claim 1 further having a bumper mounted in the casing near the surface to cushion the upward motion of the pump tool if the pump tool raises faster than normal.

5. A pump tool for pumping oil from a gaseous well having a casing of predetermined internal diameter extending from the surface to below the oil level, comprising:

a body formed of plastic and defining an upper chamber and a lower chamber therein;

means for forming a seal between the exterior of the body at a first position along the body and the adjacent inner surface of the casing to prevent oil or gas flow past the exterior of the body;

the body having an upper vent to vent the upper chamber to the exterior of the body above the seal means;

the body having a lower vent to vent the lower chamber to the exterior of the body below the seal means;

means for preventing flow from the lower chamber to the upper chamber when the tool has dropped below the oil level until a predetermined hydrostatic head of oil is provided above the pump tool to allow gas pressure to build up beneath the tool and lift the tool, and oil thereabove to the surface; and a separator for separating oil from the gas/oil mixture in the lower chamber for flow into the upper chamber.

6. The pump tool of claim 5 wherein the separator includes at least one tube having a passage therethrough interconnecting the upper chamber and the lower chamber, a float in the lower chamber defining an annular chamber into which the tube extends, the annular chamber communicating with the lower chamber through at least one port formed in the float proximate an upper end of the annular chamber, and a seal in said annular chamber to seal the passage as the float is floated upward to a first position relative the tube.

* * * * *

UNITED STATES PATENT AND TRADEMARK OFFICE

CERTIFICATE OF CORRECTION

PATENT NO. : 5,127,803
DATED : July 7, 1992
INVENTOR(S) : Walter

It is certified that error appears in the above-indentified patent and that said Letters Patent is hereby corrected as shown below:

Column 3, line 28, insert a --.--after the word --chamber--.

Column 5, line 64, insert a --.--after the word --blowout--.

Column 7, line 13, delete the word --top--.

Column 7, line 31 delete the words --tot he-- and insert the words --to the--

Signed and Sealed this

First Day of February, 1994

Bruce Lehman

*Attest:*

BRUCE LEHMAN

*Attesting Officer*

*Commissioner of Patents and Trademarks*